US007017572B2

(12) United States Patent
Cadima

(10) Patent No.: US 7,017,572 B2
(45) Date of Patent: Mar. 28, 2006

(54) METHOD AND APPARATUS FOR GAS RANGES

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/445,595

(22) Filed: May 27, 2003

(65) Prior Publication Data

US 2004/0241604 A1 Dec. 2, 2004

(51) Int. Cl.
*F24C 3/00* (2006.01)

(52) U.S. Cl. ..... 126/39 E; 431/349; 431/350

(58) Field of Classification Search ..... 431/159, 431/266, 354, 349, 350; 126/39 R, 39 E
See application file for complete search history.

(56) References Cited

U.S. PATENT DOCUMENTS 3,796,535 A * 3/1974 De Gouville ..... 431/349
5,397,234 A * 3/1995 Kwiatek ..... 431/264
5,800,159 A * 9/1998 Maughan et al. ..... 431/349
5,899,681 A 5/1999 Maughan
6,067,978 A * 5/2000 Schlosser et al. ..... 126/41 R
6,082,994 A 7/2000 Grandveau et al.
6,092,518 A 7/2000 Dane
6,095,802 A 8/2000 Kwiatek
6,135,764 A * 10/2000 Kwiatek ..... 431/266
6,244,263 B1 * 6/2001 Schlosser et al. ..... 126/39 R

* cited by examiner

*Primary Examiner*—Ehud Gartenberg
*Assistant Examiner*—James G. Barrow
(74) *Attorney, Agent, or Firm*—H. Neil Houser, Esq.; Armstrong Teasdale LLP

(57) ABSTRACT

A gas burner assembly for connection to a source of gas includes a burner body including at least one receptacle, a burner cap positioned on the burner body, at least two isolation walls coupled to the burner body, and at least one projection extending from the burner cap. The projection is configured to allow substantially uniform gas distribution through a plurality of burner ports at a first gas input rate, and configured to limit the gas distribution to at least one burner port at a second input rate greater than the first input rate input rate.

29 Claims, 10 Drawing Sheets

Streamlines of fluid flow at low input rate show minimal effect of distribution of gas.

Streamlines for burner input of approximately 5 times that of Figure 13.

Flow distribution through desired ports with and without (baseline) added geometries.

Definition of variables

METHOD AND APPARATUS FOR GAS RANGES

BACKGROUND OF THE INVENTION

This invention relates generally to a method an apparatus for gas burners, and, more particularly, a method and apparatus for gas surface burners used in a gas cooking product.

Gas surface burners used in cooking products typically include a burner base, a burner head including a plurality of burner ports through which a gas is distributed, and a burner cap positioned over the burner head. At least some known burners include a plurality of burner ports in the base. At least some known burners include a cap and a burner head that are physically integrated. Other known burners include a cap and a head that are coupled and then positioned over the burner base. Both designs often include a circular region of increased gas volume near the burner ports. This area of increased gas volume facilitates allowing angular variations in pressure to equalize such that a gas flow through each burner port is approximately equal. Typically, when a reduced flow through a particular port or ports is desired, the respective ports are reduced in area to reduce the gas flow through the burner ports. However, producing a burner with various sized burner ports can be difficult to design, detrimental to various performance characteristics such as inability to support flames at the reduced ports at very low input rates, and costly to fabricate.

BRIEF DESCRIPTION OF THE INVENTION

In one aspect, a gas burner assembly for connection to a source of gas is provided. The gas burner assembly includes a burner body including at least one receptacle, a burner cap positioned on the burner body, at least two isolation walls coupled to the burner body, and at least one projection extending from the burner cap. The projection is configured to allow substantially uniform gas distribution through a plurality of burner ports at a first gas input rate, and configured to limit the gas distribution to at least one burner port at a second input rate greater than the first input rate input rate.

In another aspect, a gas range is provided. The gas range includes a cooktop and a gas burner assembly for connection to a source of gas positioned in the cooktop. The gas burner assembly includes a burner body including at least one receptacle, a burner cap positioned on the burner body, at least two isolation walls coupled to the burner body, and at least one tripping pin extending from the burner cap. The tripping pin is configured to allow substantially uniform gas distribution through a plurality of burner ports at a first gas input rate, and configured to limit gas distribution to at least one burner port at a maximum input rate greater than the first input rate input rate.

In a further aspect, a method for varying a gas output of a gas range burner assembly is provided. The method includes forming at least one receptacle in a burner body, positioning a burner cap on the burner body, forming at least two isolation walls in the burner body, and forming at least one projection on the burner cap, the projection configured to allow substantially uniform gas distribution through a plurality of burner ports at a first gas input rate, and configured to limit the gas distribution to at least one burner port at a second input rate greater than the first input rate input rate.

DETAILED DESCRIPTION OF THE INVENTION

While the methods and apparatus are herein described in the context of a gas-fired cooktop, as set forth more fully below, it is contemplated that the herein described method and apparatus may find utility in other applications, including, but not limited to, gas heater devices, gas ovens, gas kilns, gas-fired meat smoker devices, and gas barbecues. In addition, the principles and teachings set forth herein may find equal applicability to combustion burners for a variety of combustible fuels. The description hereinbelow is therefore set forth only by way of illustration rather than limitation, and any intention to limit practice of the herein described methods and apparatus to any particular application is expressly disavowed.

Figure 1:
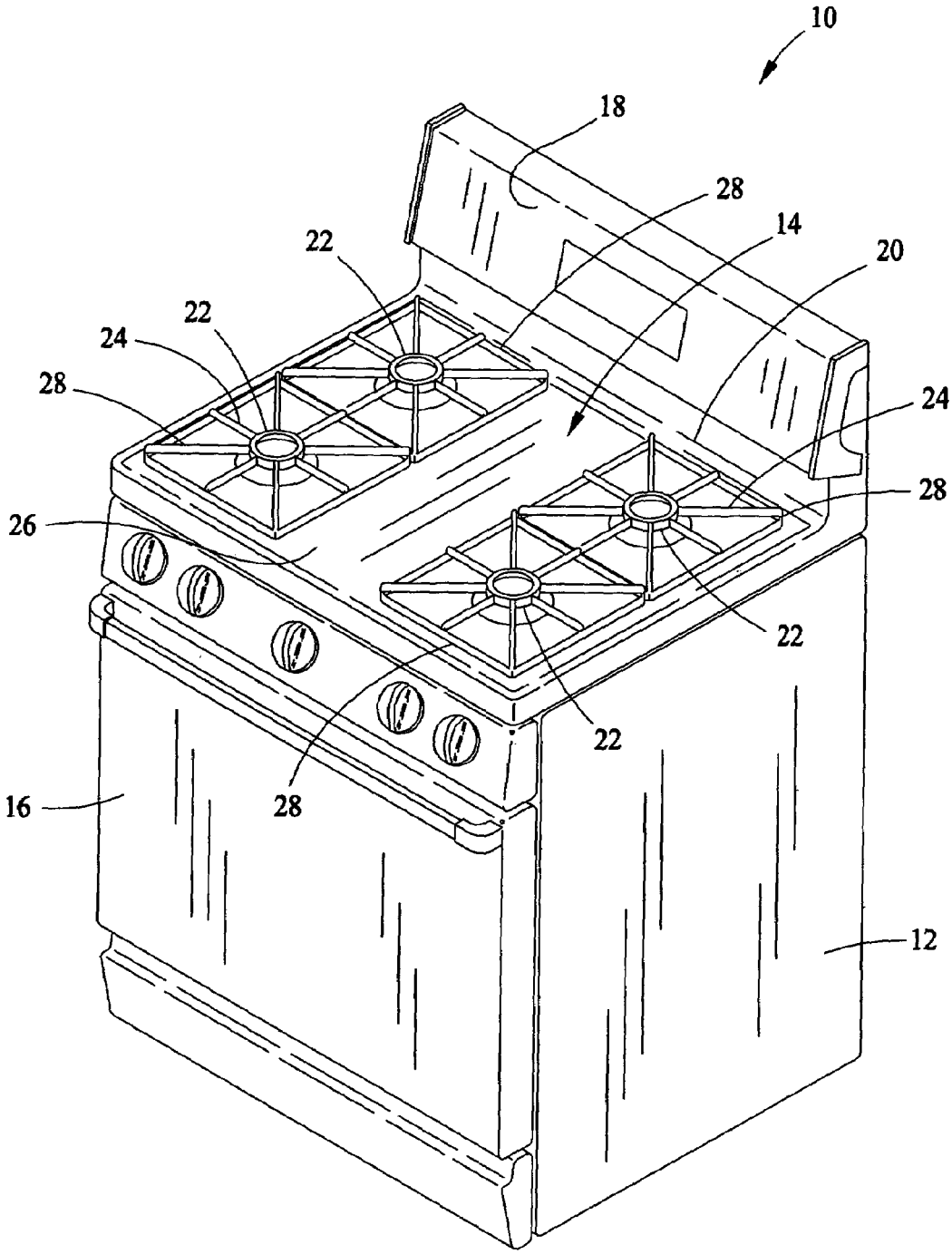
FIG. 1 is perspective view of an oven range.

FIG. 1 illustrates an exemplary free standing gas range 10 in which the herein described methods and apparatus may be practiced. Range 10 includes an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and contains various control selectors (not shown) for selecting operative features of heating elements for cooktop 14 and the oven. It is contemplated that the herein described methods and apparatus is applicable, not only to cooktops which form the upper portion of a range, such as range 10, but to other forms of cooktops as well, such as, but not limited to, built in cooktops that are mounted to a kitchen counter. Therefore, gas range 10 is provided by way of illustration rather than limitation, and accordingly there is no intention to limit application of the herein described methods and apparatus to any particular appliance or cooktop, such as range 10 or cooktop 14.

Cooktop 14 includes four gas fueled burner assemblies 22 which are positioned in spaced apart pairs positioned adjacent each side of cooktop 14. Each pair of burner assemblies 22 is surrounded by a recessed area 24 of cooktop 14. Recessed areas 24 are positioned below an upper surface 26 of cooktop 14 and serve to catch any spills from cooking utensils (not shown in FIG. 1) being used with cooktop 14. Each burner assembly 22 extends upwardly through an opening in recessed areas 24, and a grate 28 is positioned over each burner 22. Each grate 28 includes a flat surface thereon for supporting cooking vessels and utensils over burner assemblies 22 for cooking of meal preparations placed therein.

While cooktop 14 includes two pairs of grates 28 positioned over two pairs of burner assemblies 22 it is contemplated that greater or fewer numbers of grates could be employed with a greater or fewer number of burners without departing from the scope of the herein described methods and apparatus.

Figure 2:
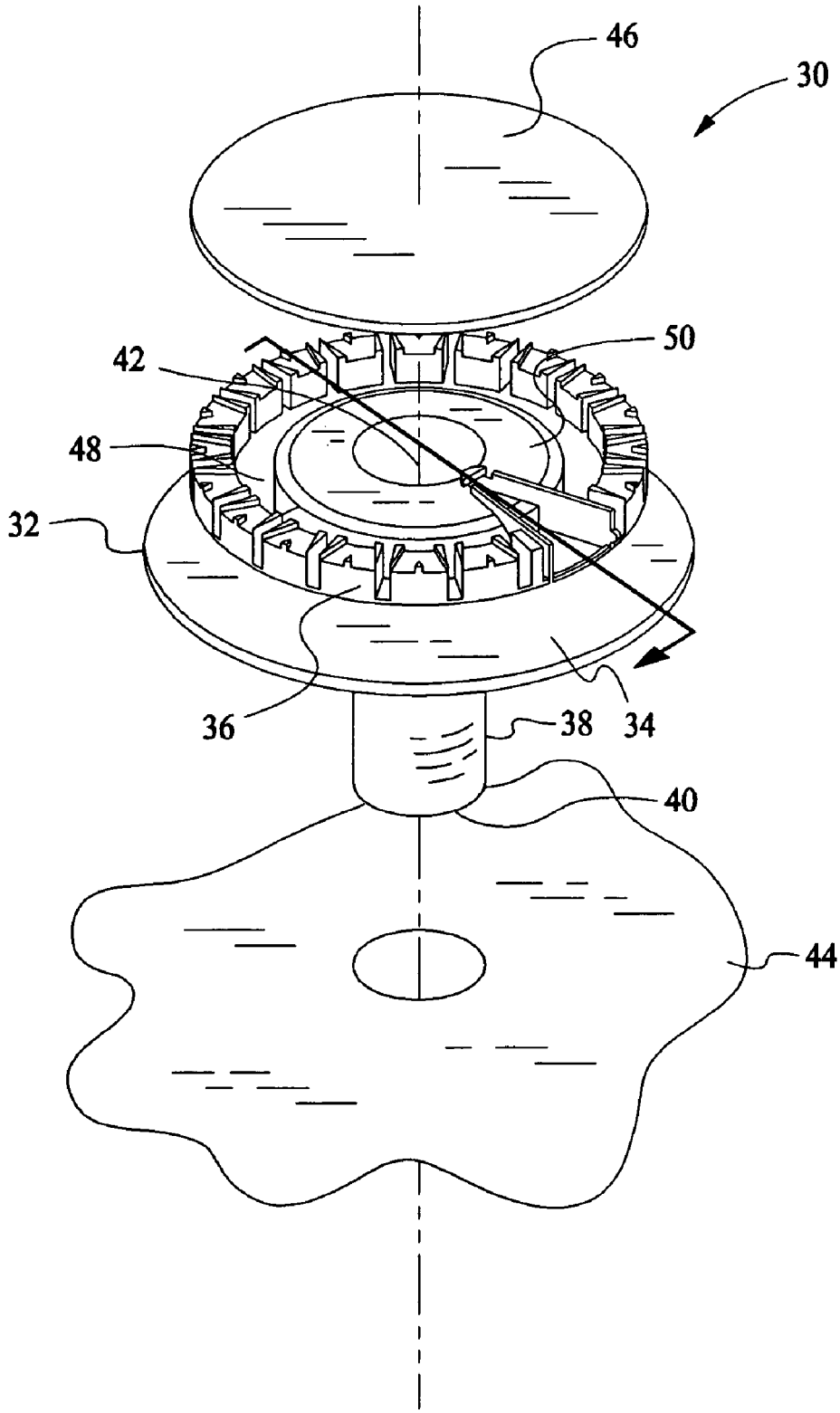
FIG. 2 is an exploded view of a burner assembly.

FIG. 2 is an exploded perspective view of an exemplary burner assembly 30 that can be used with gas range 10 (shown in FIG. 1). Burner assembly 30 includes a burner body 32, a solid base portion 34, and a cylindrical isolation wall 36 extending axially from the periphery of base portion 34. A main gas conduit 38 having an entry area 40 and a burner throat region 42 is open to the exterior of burner body 32 and defines a passage which extends axially through the center of burner body 32 to provide fuel/air flow to burner assembly 30. As used herein, the term "gas" refers to a combustible gas or gaseous fuel-air mixture.

Burner assembly 30 is mounted on a support surface 44, such as cooktop 14, of a gas cooking appliance such as a range or a cooktop. A cap 46 is disposed over the top of burner body 32, defining therebetween an annular main fuel chamber 48 and annular diffuser region (not shown). A toroidal-shaped upper portion 50 of burner body 32, immediately bordering burner throat 42, in combination with cap 46 defines the annular diffuser region therebetween. Cap 46 can be fixedly attached to isolation wall 36 or other designated attachment point or can simply rest on isolation wall 36 for easy removal. Burner assembly 30 also includes at least one igniter (not shown) extending through an opening in base portion 34. While one type of burner is described and illustrated, the herein described methods and apparatus are applicable to other types of burners, such as stamped aluminum burners and separately mounted orifice burners.

Figure 3:
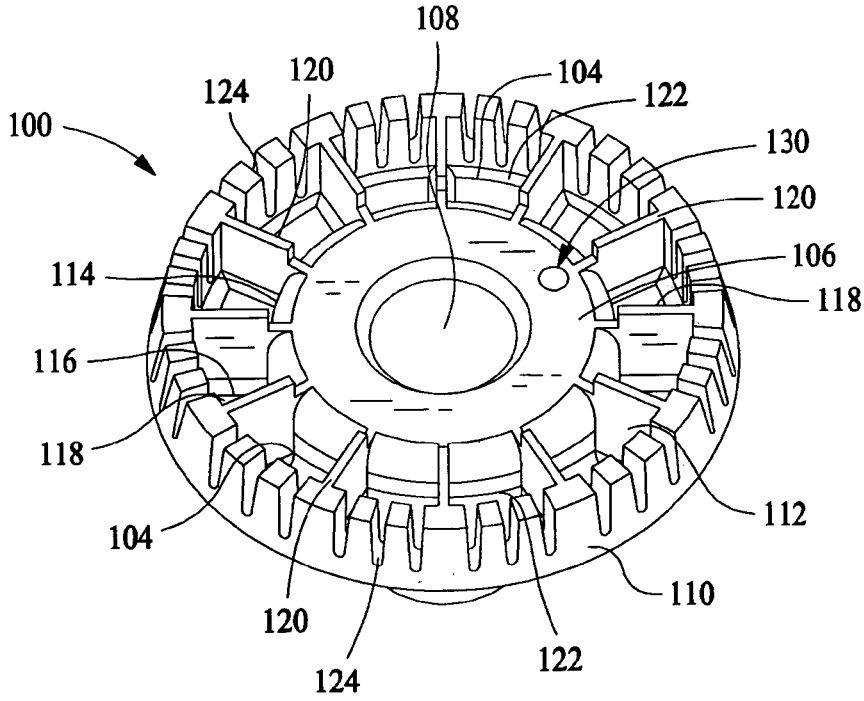
FIG. 3 is a perspective view of a burner base that can be used with the gas range shown in FIG. 1.
Figure 4:
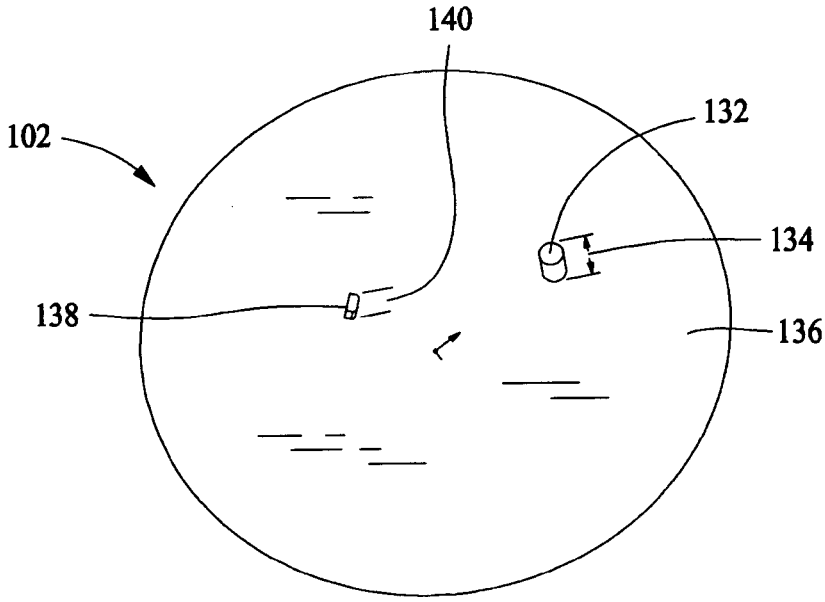
FIG. 4 is a perspective view of a burner cap that can be used with the burner base shown in FIG. 3.
Figure 5:
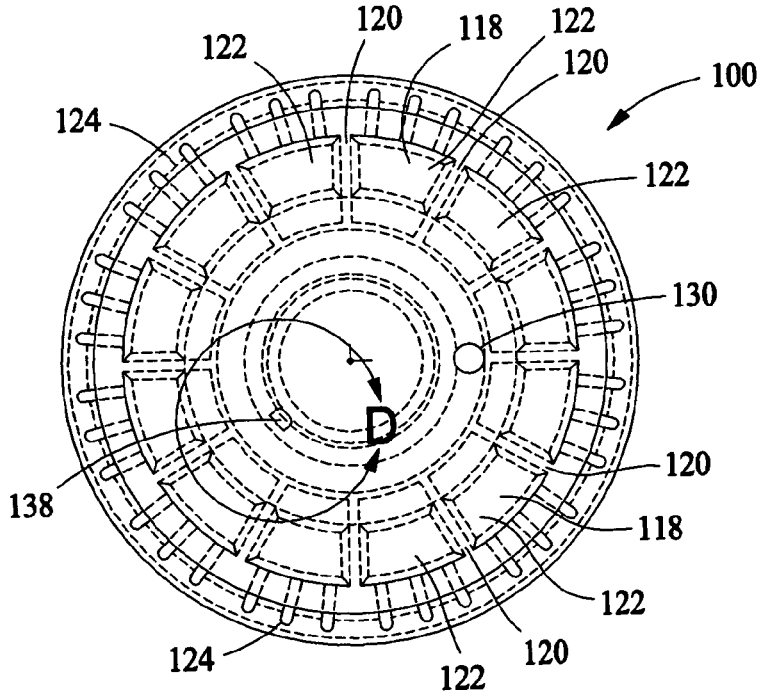
FIG. 5 is a top view of the burner base and cap assembly shown in FIGS. 3 & 4.
Figure 6:
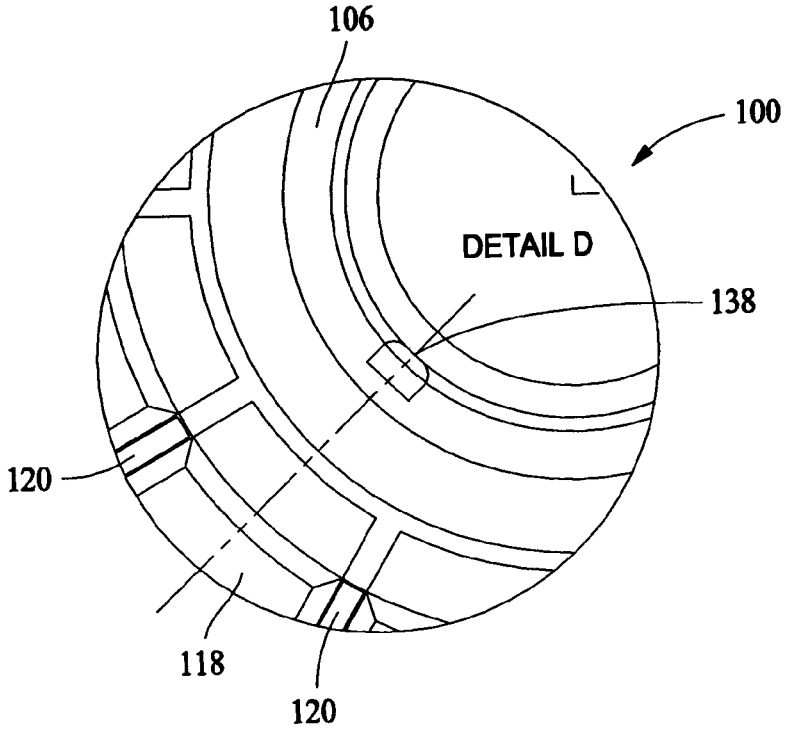
FIG. 6 is a detailed view of a portion of the burner base and cap assembly shown in FIG. 5.

FIG. 3 is a perspective view of a burner base 100 that can be used with gas range 10 (shown in FIG. 1). FIG. 4 is a perspective view of a burner cap 102 that can be used with burner base 100. FIG. 5 is a top view of a burner base and cap assembly 100 shown in FIGS. 3 and 4. FIG. 6 is an exploded view of a portion of burner base 100 shown in FIG. 5. Burner base 100 can be mounted on a support surface 44 (shown in FIG. 2), such as cooktop 14 (shown in FIG. 1) of a gas cooking appliance 10. Cap 102 is disposed over the top of burner base 100, defining therebetween an annular main fuel chamber 104 and annular diffuser region (not shown). A toroidal-shaped upper portion 106 of burner base 100, immediately bordering burner throat 108, in combination with cap 102 defines the annular diffuser region therebetween. Cap 102 can be fixedly attached to an outer isolation wall 110 or other designated attachment point or can simply rest on outer isolation wall 110 for easy removal. While one type of burner is described and illustrated, the herein described methods and apparatus are applicable to other types of burners, such as stamped aluminum burners and separately mounted orifice burners.

Annular main fuel chamber 104 is defined by an outer surface 112, an inner surface 114, a lower surface 116, and cap 102. A plurality of primary burner ports 118 are disposed between outer surface 112 and inner surface 114. A plurality of isolation walls 120 extend between outer surface 112 and inner surface 114 thereby separating the plurality of burner ports 118 into a plurality of individual burner ports 122 so as to provide a path to allow fluid communication with main fuel chamber 104, each primary burner port 122 being adapted to support a respective main flame through each flame port 124. Primary burner ports 122 are typically, although not necessarily, evenly spaced about inner surface 114. As used herein, the term "port" refers to an aperture of any shape from which a flame may be supported.

Burner base 100 includes a receptacle 130 defined within upper portion 106 of burner base 100. Burner cap 102 includes at least one indexing pin 132, having a length 134, mechanically coupled to a first side 136 of burner cap 102. In one embodiment, a plurality of cylindrically shaped indexing pins 132 are positioned at least partially within a plurality of respective receptacles to facilitate positively positioning burner cap 102 on burner base 100. In another embodiment, a single indexing pin that is non-cylindrically shaped, such as, but not limited to, square, rectangular, and triangular is used to facilitate positively positioning burner cap 102 on burner base 100. Burner cap 102 also includes at least one tripping pin 138, having a length 140, mechanically coupled to first side 136 of burner cap 102. In one embodiment, length 134 is greater than length 140.

In use, burner cap 102 is positioned above burner base 100 until receptacle 130 and indexing pin 132 are approximately aligned. Burner cap 102 is then lowered onto burner base 100 until indexing pin 132 is slidably coupled with receptacle 130 and tripping pin 138 is contacting upper portion 106 of burner base 100.

Figure 7:
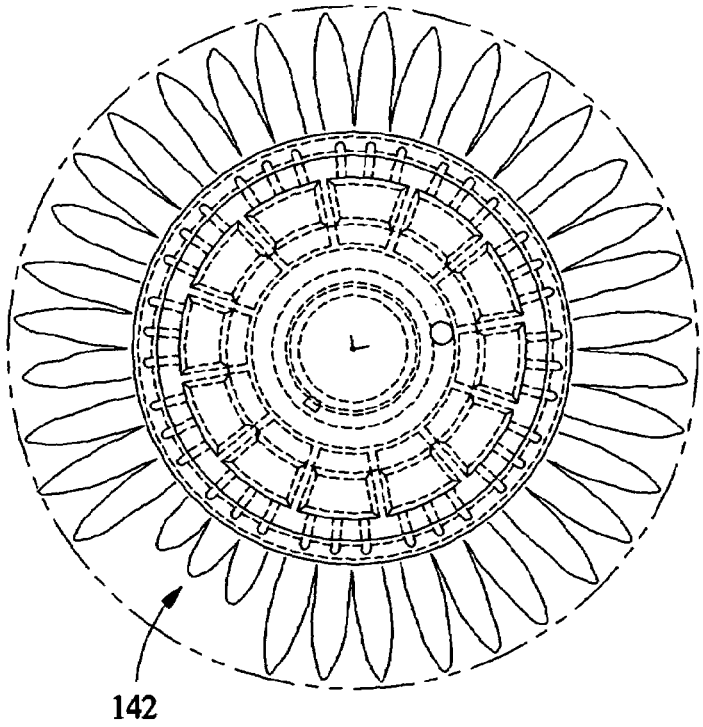
FIG. 7 is a burner flame pattern generated using a single tripping pin.

FIG. 7 is a burner flame pattern generated using a single indexing pin 132. As shown, using single tripping pin 138 generates a single reduced flame area 142 around a periphery of burner base 100 and a substantially uniform flame pattern around the rest of the periphery. Using single tripping pin 138 facilitates providing an increased heat output of surface burners without substantially increasing the heat output in an area where the operator is often positioned, i.e. adjacent tripping pin 138.

Figure 8:
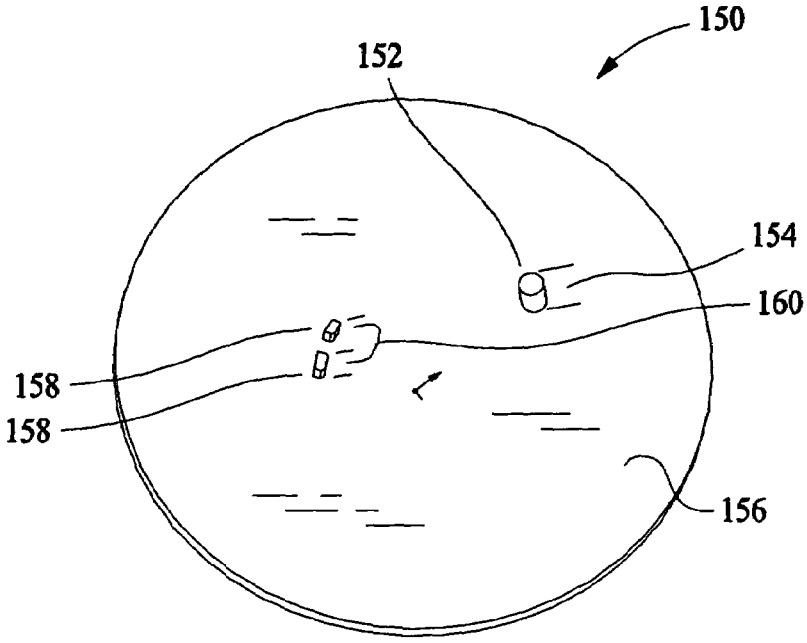
FIG. 8 is a burner cap that can be used with the gas range shown in FIG. 1.
Figure 9:
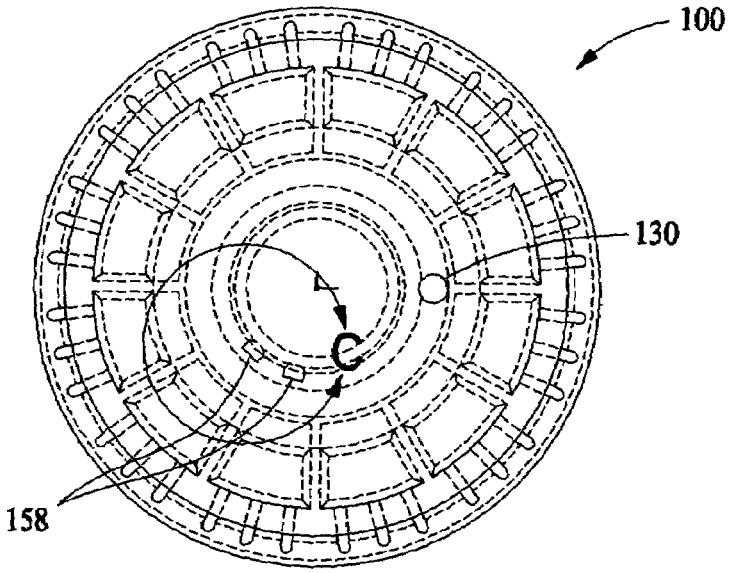
FIG. 9 is a top view of a burner base and cap assembly shown in FIGS. 3 and 8.
Figure 10:
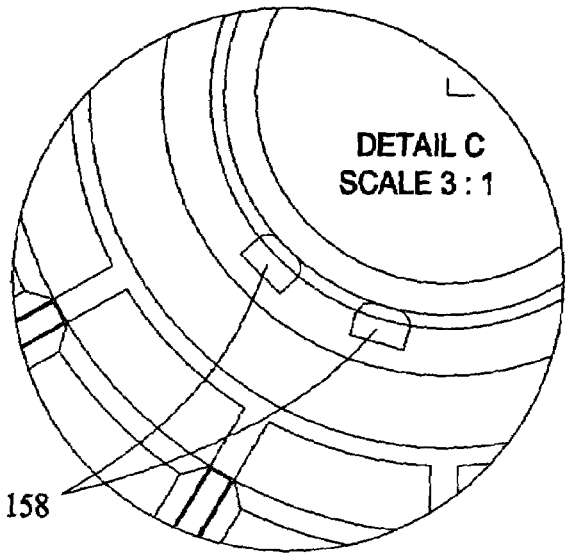
FIG. 10 is a detailed view of a portion of the burner base and cap assembly shown in FIG. 9.

FIG. 8 is a burner cap 150 that can be used with gas range 10 (shown in FIG. 1). FIG. 9 is a top view of a burner base 100 (shown in FIG. 3) that can be used with burner cap 150. FIG. 10 is an exploded view of a portion of burner base 100 shown in FIG. 9. Burner cap 150 includes a single indexing pin 152, having a length 154, mechanically coupled to a first side 156 of burner cap 150. In the exemplary embodiment, receptacle 130 (shown in FIG. 3) and indexing pin 152 are substantially cylindrically shaped and sized such that indexing pin 152 can be positioned at least partially within receptacle 130. In another exemplary embodiment, receptacle 130 and indexing pin 152 are shaped in a non-cylindrical shape, such as, but not limited to, square, rectangular, and triangular. Burner cap 150 also includes a plurality of tripping pins 158, having a length 160, mechanically coupled to first side 156 of burner cap 150. In one embodiment, length 160 is greater than length 154.

In use, burner cap 150 is positioned above burner base 100 until receptacle 130 and indexing pin 152 are approximately aligned. Burner cap 150 is then lowered onto burner base 100 until indexing pin 152 is slidably coupled with receptacle 130 and tripping pins 158 are effectively contacting, i.e. proximate to, upper portion 106 of burner base 100.

Figure 11:
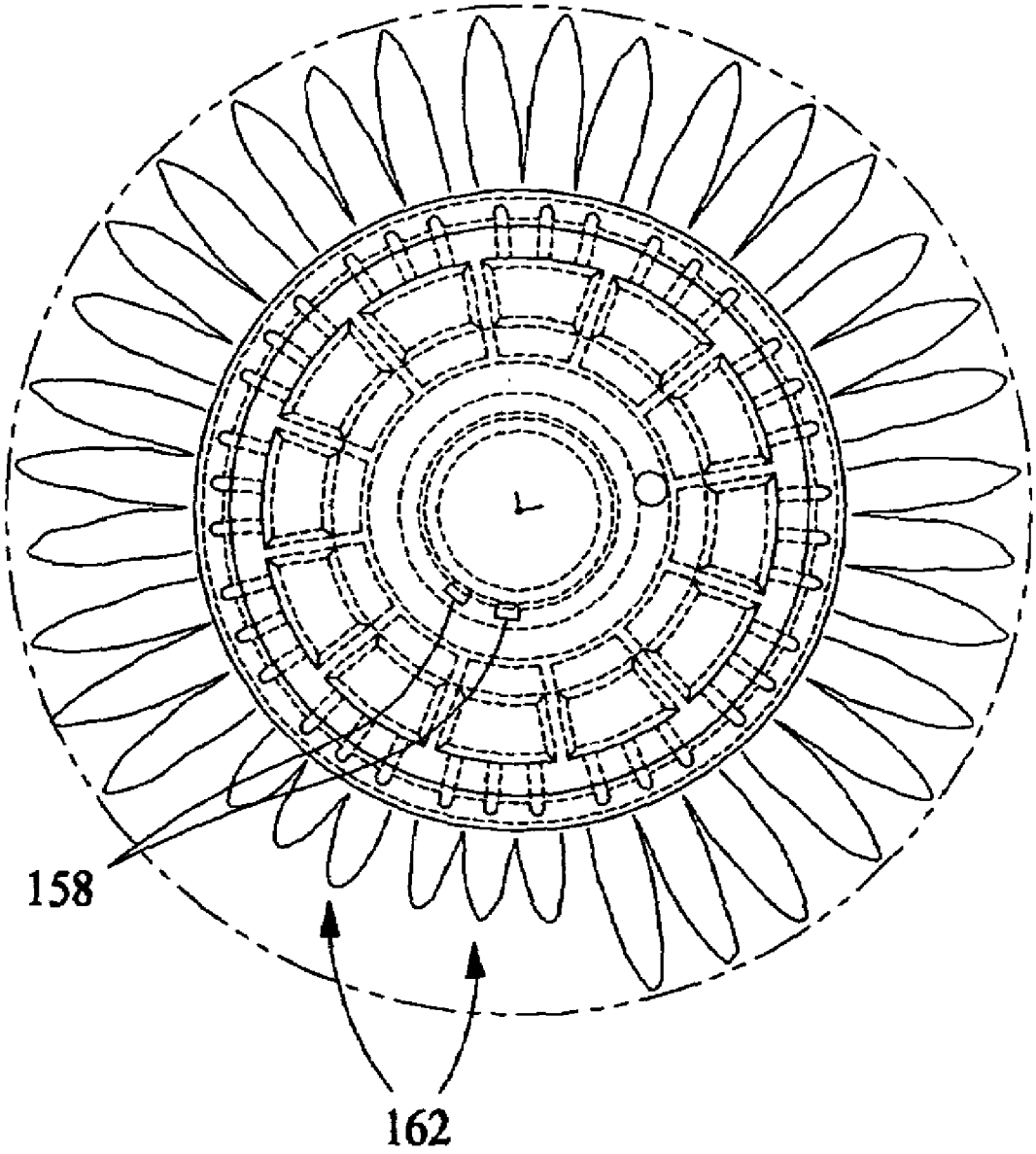
FIG. 11 is a burner flame pattern generated using two tripping pins.

FIG. 11 is a burner flame pattern generated using two tripping pins 158. As shown, using two tripping pins 158 generates two reduced flame areas 162 around a periphery of burner base 100 and a substantially uniform flame pattern around the rest of the periphery. Using two tripping pins 158 facilitates providing an increased heat output of surface burners without substantially increasing the heat output in an area where the operator is often positioned, i.e. adjacent tripping pins 158.

Figure 12:
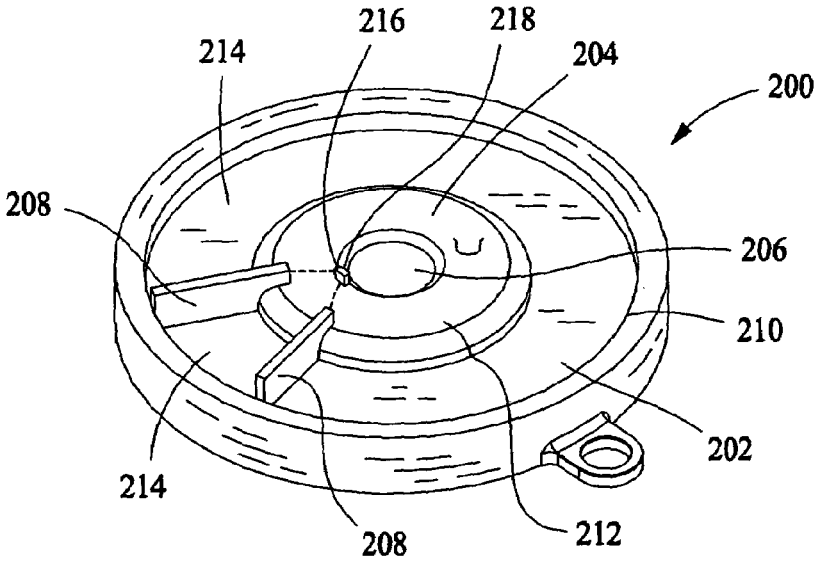
FIG. 12 is a perspective view of a burner base that can be used with the gas range shown in FIG. 1.

FIG. 12 is a perspective view of a burner base 200 that can be used with gas range 10 (shown in FIG. 1). Burner base 200 can be mounted on a support surface 44 (shown in FIG. 1), such as cooktop 14 (shown in FIG. 2) of gas cooking appliance 10. A cap (not shown) is disposed over the top of burner base 200, defining therebetween an annular main fuel chamber 202. A toroidal-shaped upper portion 204 of burner base 200, immediately bordering a burner throat 206, in combination with the burner cap defines the annular diffuser region therebetween. In the exemplary embodiment, the cap includes a plurality of burner ports (not shown) mechanically coupled to the cap. While one type of burner is described and illustrated, the herein described methods and apparatus are applicable to other types of burners, such as stamped aluminum burners and separately mounted orifice burners.

Burner base 200 includes at least two isolation walls 208 that extend between an outer surface 210 and an inner surface 212 of burner base 200 thereby separating main fuel chamber 202 into a plurality of individual fuel chambers 214 so as to provide a path to allow fluid communication between burner throat 206 and each primary burner port (not shown). Burner base 200 also includes at least one tripping pin 216 mechanically coupled to upper portion 204 of burner base 200, and positioned approximately at an apex 218 formed by isolation walls 208. Tripping pin 216 is configured to separate a gas/air mixture entering into burner base 200, and isolation walls 208 are configured to isolate the desired burner ports and facilitate preventing a plurality of angular pressures from inside main fuel chamber 202 from equalizing within main fuel chamber 202 around the desired ports to be affected.

Figure 13:
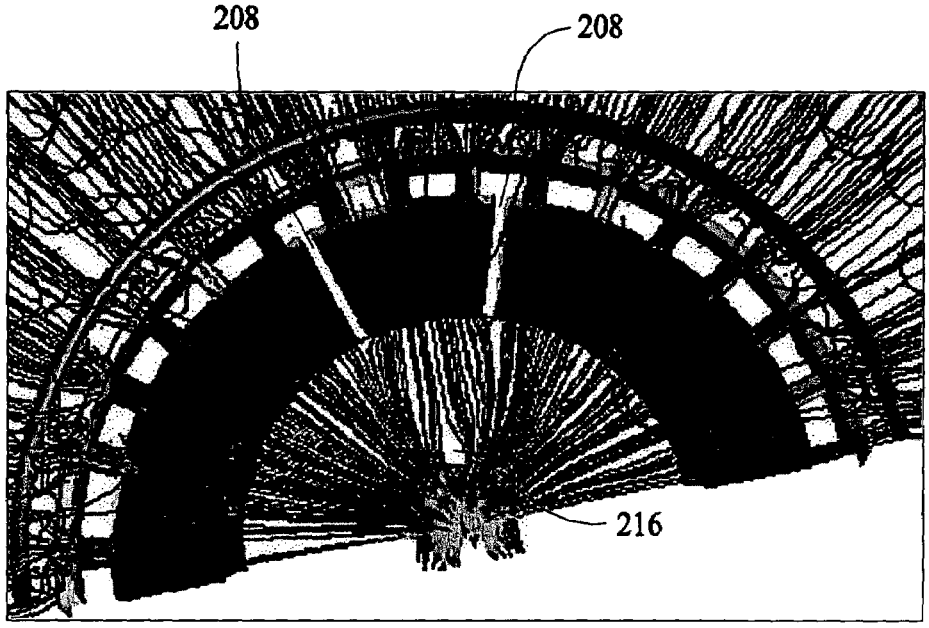
FIG. 13 is an illustration of fluid flow streamlines at a first gas/air input rate.
Figure 14:
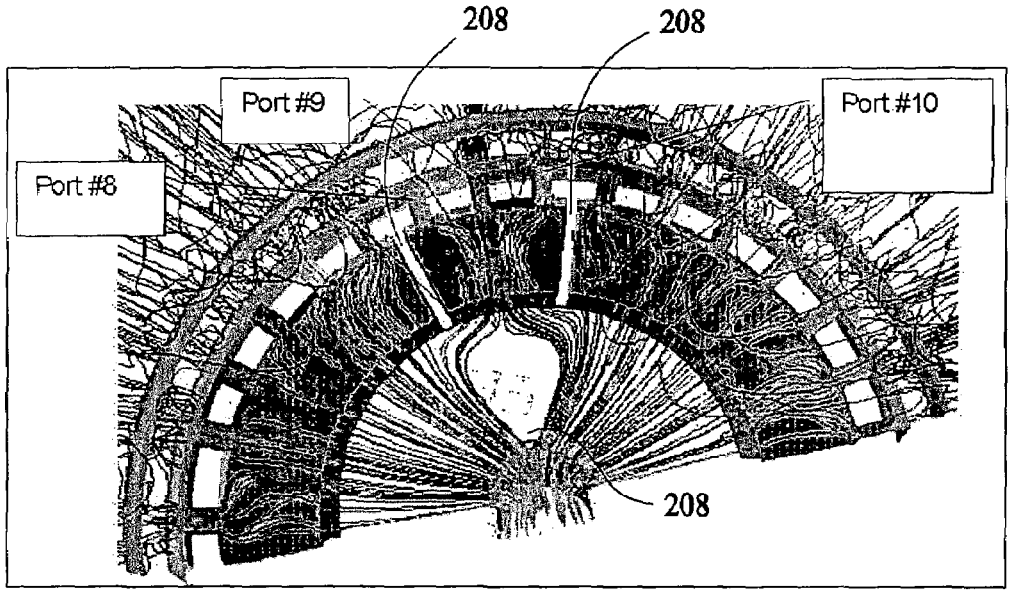
FIG. 14 is an illustration of fluid flow at a second gas/air input rate.

In use, when a relatively low gas/air mixture is input into burner base 200, a separation of the gas/air mixture influx around tripping pin 216 is relatively small and recovers rapidly, therefore producing a negligible effect on the gas distribution through all the burner ports as shown in FIG. 13. FIG. 14 is a graphical illustration of the fluid flow streamlines at gas/air input rates approximately five times greater than the gas/air input rates is shown in FIG. 13. As shown in FIG. 14, the gas/air flow is separating dramatically around tripping pin 216, and isolation walls 208 facilitate preventing the majority of the diverted gas/air mixture influx from recovering.

Figure 15:
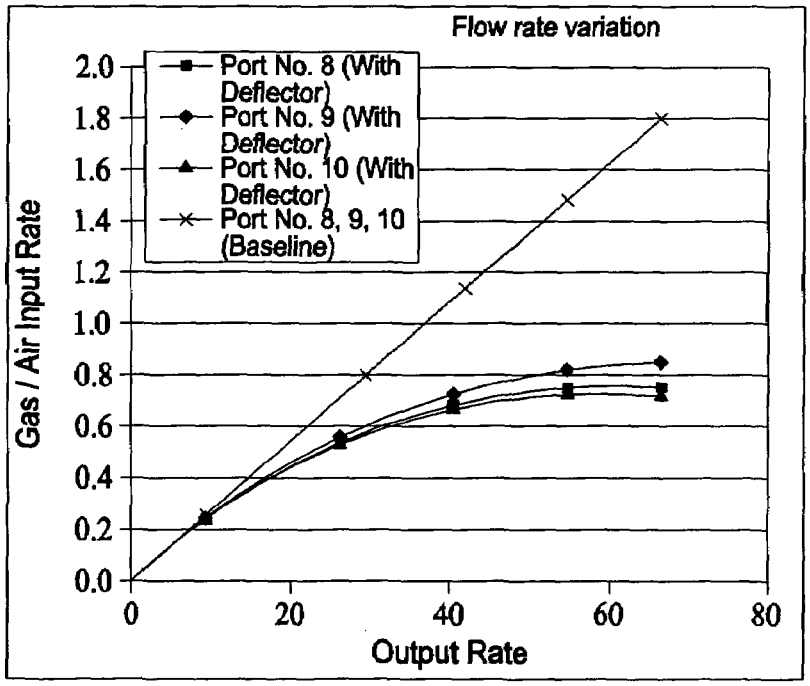
FIG. 15 is a graphical illustration of a flow distribution.

FIG. 15 is a graphical illustration of a flow distribution of output rate with respect to gas/air input for burner ports using the methods and apparatus described herein and a known burner assembly. As shown in FIG. 15, the ports within isolation walls 208 have relatively the same outputs at the baseline ports for medium to low gas/air input rates. At higher gas/air input rates, tripping pin 216 and isolation walls 208 produce a relatively constant output rate while the baseline ports increase directly proportional to the input rate. In the exemplary embodiment, a plurality of tripping pins 216 can be positioned between a plurality of isolation walls 208 such that the quantity of ports that can be affected by the methods and apparatus described herein can be few or many, as desired. Additionally, the methods and apparatus described herein can be applied to a plurality of different burner configurations since isolation walls 208 and tripping pin 216 can be positioned on a plurality of bases or burner heads with no impact to its effectiveness.

Figure 16:
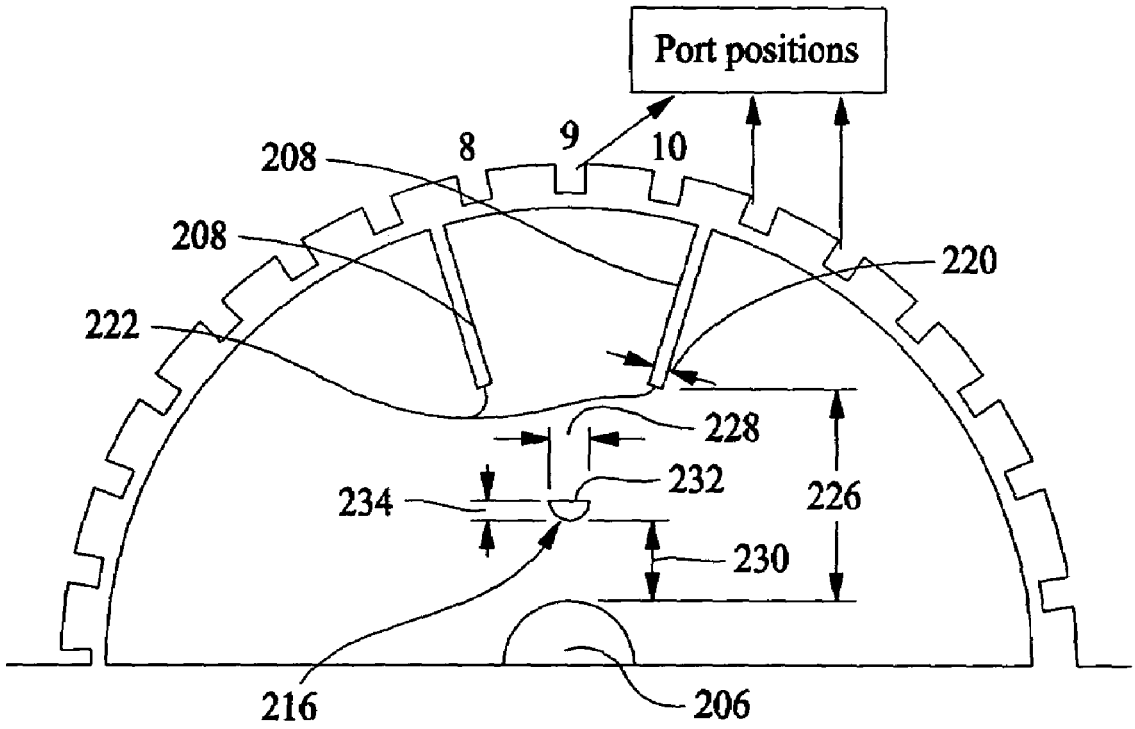
FIG. 16 is a top schematic view of the exemplary burner base shown in FIG. 12.

FIG. 16 is a top schematic view of exemplary burner base 200 shown in FIG. 12. Burner base 200 includes two isolation walls 208 tat have a width 220, and extend from outer wall 210 to inner wall 212 and at least partially over upper portion 204. In the exemplary embodiment, an end 222 of isolation walls 208 is separated from burner throat region 206 by a first distance 226. Burner assembly 200 also includes tripping pin 216, including a first diameter 228, that is separated from burner throat region 206 by a second distance 230. In the exemplary embodiment, tripping pin 216 also includes a top portion 232 having a height 234 and extending from an end of tripping pin 216. In one embodiment, at least one of width 220, height 234, first distance 226, first diameter 228, and second distance 230, can be adjusted to vary the output of desired ports between isolations walls 208 of burner assembly 200. Additionally, when a plurality of tripping pins are utilized in a burner assembly to generate a plurality of areas of reduced flame regions, each region of reduced flame can be tuned independently of every other region by adjusting width 220, height 234, first distance 226, first diameter 228, and second distance 230.

The methods and apparatus described herein facilitate providing substantially higher heat outputs on gas surface burners, thereby improving an elapsed time to bring a food load to a desired temperature. An increase in heat output of surface burners is achieved overall without substantially increasing the heat output in these locations, and heat distribution is substantially uniform at relatively low input rates.

While the invention has been described in terms of various specific embodiments, those skilled in the art will recognize that the invention can be practiced with modification within the spirit and scope of the claims.

What is claimed is:

1. A gas burner assembly for connection to a source of gas, said gas burner assembly comprising;

a burner body comprising at least one receptacle;

a burner cap positioned on said burner body;

at least two isolation walls coupled to said burner body; and at least one projection extending from said burner cap and separated from said isolation walls by a distance, said projection configured to allow substantially uniform gas distribution through a plurality of burner ports at a first gas input rate, and configured to limit said gas distribution to at least one said burner port at a second input rate greater than the first input rate.

2. A gas burner assembly in accordance with claim 1 wherein the second input rate is a maximum input rate.

3. A gas burner assembly in accordance with claim 1 wherein said burner cap further comprises at least one indexing pin configured to slidably couple said receptacle.

4. A gas burner assembly in accordance with claim 1 wherein said at least one projection comprises exactly two tripping pins.

5. A gas burner assembly in accordance with claim 1 wherein said at least one projection includes a width and a height, said width and height configured to vary a gas distribution to at least one said burner port at said second input rate.

6. A gas burner assembly in accordance with claim 3 wherein said indexing pin includes a first height and said projection includes a second height less than said first height.

7. A gas burner assembly in accordance with claim 1 further comprising a burner base, said at least one projection configured to separate a gas/air mixture entering said burner base.

8. A gas burner assembly in accordance with claim 1 wherein said projection is separated from a burner throat region by a first distance, and separated from said isolation walls by a second distance, said first distance and said second distance configured to vary a gas distribution to at least one said burner port at said second input rate.

9. A gas burner assembly in accordance with claim 1 wherein said at least one projection is configured to at least partially obstruct a flow of gas to at least one burner port at said second input rate.

10. A gas range comprising:

a cooktop; and a gas burner assembly for connection to a source of gas positioned in said cooktop, said gas burner assembly comprising:

a burner body comprising at least one receptacle;

a burner cap positioned on said burner body;

at least two isolation walls coupled to said burner body; and at least one tripping pin extending from said burner cap and separated from said isolation walls by a distance, said tripping pin configured to allow substantially uniform gas distribution through a plurality of burner ports at a first gas input rate, and configured to limit said gas distribution to at least one said burner port at a maximum input rate greater than the first input rate.

11. A gas range in accordance with claim 10 wherein said burner cap further comprises at least one indexing pin configured to slidably couple said receptacle.

12. A gas range in accordance with claim 10 wherein said burner cap further comprises exactly two tripping pins.

13. A gas range in accordance with claim 10 wherein said at least one tripping pin includes a width and a height, said width and height configured to vary a gas distribution to at least one said burner port at said maximum input rate.

14. A gas range in accordance with claim 11 wherein said indexing pin includes a first height and said tripping pin includes a second height less than said first height.

15. A gas range in accordance with claim 10 wherein said tripping pin is separated from a burner throat region by a first distance, and separated from said isolation walls by a second distance, said first distance and said second distance adjustably configured to vary a gas distribution to at least one said burner port at said maximum input rate.

16. A method for varying a gas output of a gas range burner assembly, said method comprising:

forming at least one receptacle in a burner body;

positioning a burner cap on the burner body;

forming at least two isolation walls in the burner body; and forming at least one projection on the burner cap that is separated from the isolation walls by a distance, the projection configured to allow substantially uniform gas distribution through a plurality of burner ports at a first gas input rat, and configured to limit the gas distribution to at least one burner port at a second input rate greater than the first input rate.

17. A method for varying a gas output of a gas range burner assembly in accordance with claim 16 wherein said positioning a burner cap on the burner body comprises positioning a burner cap comprising at least one indexing pin configured to slidably couple the receptacle on the burner body.

18. A method for varying a gas output of a gas range burner assembly in accordance with claim 16 wherein said forming at least one projection on the burner cap comprises forming at least one projection including a width and a height, the width and height configured to vary a gas distribution to at least one burner port at said second input rate.

19. A method for varying a gas output of a gas range burner assembly in accordance with claim 17 wherein said positioning a burner cap comprising at least one indexing pin further comprises positioning a burner cap comprising an indexing pin comprising a first height on the burner body, the projection comprising a second height less than the first height.

20. A method for varying a gas output of a gas range burner assembly in accordance with claim 16 wherein said forming at least one projection on the burner cap comprises forming at least one projection separated from a burner throat region by a first distance, and separated from the isolation walls by a second distance, the first distance and the second distance configured to vary a gas distribution to at least one burner port at the second input rate.

21. A gas range comprising:

a cooktop; and a gas burner assembly for connection to a source of gas positioned in said cooktop, said gas burner assembly comprising:

a burner body comprising at least one receptacle;

a burner cap positioned on said burner body;

at least two isolation walls coupled to said burner body; and at least one tripping pin positioned on said burner cap between said body and said burner cap and separated from said isolation walls by a distance, said tripping pin configured to allow substantially uniform gas distribution through a plurality of burner ports at a first gas input rate, and configured to limit said gas distribution to at least one said burner port at a maximum input rate greater than the first input rate.

22. A gas range in accordance with claim 21 wherein said burner cap further comprises at least one indexing pin configured to slidably couple said receptacle.

23. A gas range in accordance with claim 21 wherein said burner cap further comprises exactly two tripping pins.

24. A gas range in accordance with claim 21 wherein said at least one tripping pin includes a width and a height, said width and height configured to vary a gas distribution to at least one said burner port at said maximum input rate.

25. A gas range in accordance with claim 22 wherein said indexing pin includes a first height and said tripping pin includes a second height less than said first height.

26. A gas range in accordance wit claim 21 wherein said tripping pin is separated from a burner throat region by a first distance, and separated from said isolation walls by a second distance, said first distance and said second distance adjustably configured to vary a gas distribution to at least one said burner port at said maximum input rate.

27. A burner cap for a gas burner including a burner body having a plurality of burner ports and at least two isolation walls coupled thereto, said burner cap comprising:

a cover member disposed over a top of the burner body, said cover member having a first side facing the burner body;

a tripping pin formed on said first side of said cover member and extending toward the burner body into a fuel flow path of the burner and separated from the isolation walls by a distance, said tripping pin configured to allow substantially uniform gas distribution through the burner ports at a first gas input rate, and configured to limit gas distribution to at least one of the burner ports at a second input rate greater than the first input rate; and an indexing pin extending from said first side of said cover member, said indexing pin sized to be received in a receptacle on the burner body to positively position said cover member on the burner body.

28. A burner cap in accordance with claim 27 wherein said tripping pin has a first length and said indexing pin has a second length greater than said first length.

29. A burner cap in accordance with claim 27 wherein said cover member and the burner body cooperate to define a main fuel chamber therebetween.

* * * * *

UNITED STATES PATENT AND TRADEMARK OFFICE

CERTIFICATE OF CORRECTION

PATENT NO. : 7,017,572 B2
APPLICATION NO. : 10/445595
DATED : March 28, 2006
INVENTOR(S) : Cadima It is certified that error appears in the above-identified patent and that said Letters Patent is hereby corrected as shown below:

Column 6, line 40, delete “comprising;” and insert therefor --comprising:--.
Column 7, line 63, delete “input rat,” and insert therefor --input rate,--.
Column 8, line 56, delete “wit claim” and insert therefor --with claim--.

Signed and Sealed this

Second Day of September, 2008

JON W. DUDAS
*Director of the United States Patent and Trademark Office*